US007398882B2

(12) United States Patent
Barrett et al.

(10) Patent No.: US 7,398,882 B2
(45) Date of Patent: Jul. 15, 2008

(54) PACKAGING TRAY WITH EDGE TABS

(75) Inventors: Patrick Barrett, Milwaukie, OR (US); Ian Meyer, Milwaukie, OR (US)

(73) Assignee: Keyes Fibre Corporation, Wenatchee, WA (US)

( * ) Notice: Subject to any disclaimer, the term of this patent is extended or adjusted under 35 U.S.C. 154(b) by 303 days.

(21) Appl. No.: 10/974,527

(22) Filed: Oct. 27, 2004

(65) Prior Publication Data

US 2005/0167317 A1 Aug. 4, 2005

Related U.S. Application Data

(60) Provisional application No. 60/514,811, filed on Oct. 27, 2003.

(51) Int. Cl.
*B65D 5/54* (2006.01)
*B65D 1/24* (2006.01)

(52) U.S. Cl. ..... 206/521.15; 220/507

(58) Field of Classification Search ..... 206/521.1, 206/521.15, 521.6, 521.7, 521.8, 521.9; 220/507–508, 220/315, 323–324, 833–835
See application file for complete search history.

(56) References Cited

U.S. PATENT DOCUMENTS 2,078,488 A * 4/1937 Farnham ..... 206/521.15
2,455,295 A * 11/1948 Cox ..... 206/521.15
3,034,693 A * 5/1962 Cox ..... 206/521.8
3,357,624 A * 12/1967 Crabtree ..... 206/521.1
4,798,133 A * 1/1989 Johnson ..... 206/521.15
5,590,805 A * 1/1997 Knoss et al. ..... 220/508
5,653,345 A * 8/1997 Knoss et al. ..... 206/521.6
6,276,531 B1 * 8/2001 Andrews ..... 206/521.1

* cited by examiner

*Primary Examiner*—Bryon P Gehman
(74) *Attorney, Agent, or Firm*—Vedder Price, P.C.

(57) ABSTRACT

A packaging tray for transport and storage of product includes a tray portion and a plurality of cover portions. The tray portions is formed from a first sheet material and defined by a plurality of removably connected retail portions. Each retail portion includes a plurality of pockets formed therein, each adapted to receive the product. Each retail portion further includes an outer edge defined substantially about a periphery of the retail portion and at least one tab extending from the outer edge. Each at least one tab is removably connected with at least one tab of an adjacent retail portion along the line of weakening. The plurality of cover portions are formed from a second sheet material and each is configured for removably engagement with one of the retail portions.

17 Claims, 6 Drawing Sheets

PACKAGING TRAY WITH EDGE TABS

This application claims the benefit of U.S. Provisional application No. 60/514,811, filed Oct. 27, 2003, titled "Perforated Packaging Tray."

The present disclosure is directed to packaging trays and more particularly to packaging trays that have perforations permitting the separation of the packaging tray into multiple retail trays.

The distribution of products in industry often require significant amounts of handling between the manufacturer and the end-user. Over time, standards have evolved for packaging that permit the handling of packages to become somewhat automated. One of the standards relates to a covered tray for holding products. A standard size for covered trays is approximately 600 mm×400 mm (23.6"×15.7") for an outside tray having an inside box size of (570-580 mm)×(360-380 mm) (22.8"×15")—this is an international standard for a tray footprint. Many storage and transport systems have been designed to accommodate trays having this standard size.

While this tray size is convenient for storage and transport, it is generally too large for the retailer to ultimate utilize in a store and/or for the end-user/consumer. Thus, this disclosure is directed to an advantageous covered tray that permits the standard size tray to be separated into smaller trays that are convenient for the retailer or end-user. A retailer/end-user separated tray that is based on a larger standard sized tray has not been previously disclosed.

BRIEF DESCRIPTION OF THE DRAWINGS

Certain embodiments are shown in the drawings. However, it is understood that the present disclosure is not limited to the arrangements and instrumentality shown in the attached drawings, wherein.

DETAILED DESCRIPTION

Figure 1:
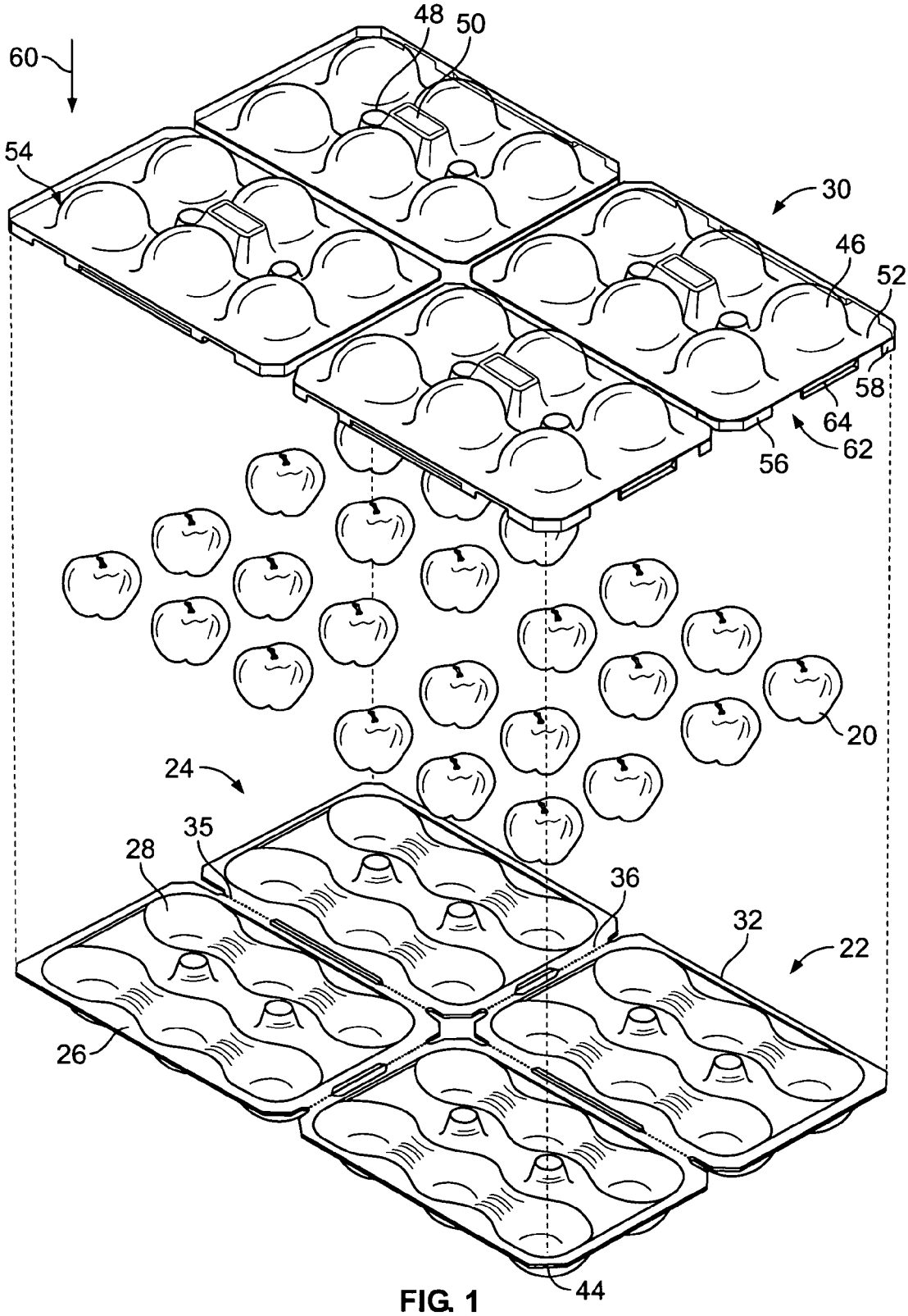
FIG. 1 illustrates an exploded view of a packaging tray for product.

For the purposes of promoting and understanding the principles disclosed herein, reference will now be made to the preferred embodiments illustrated in the drawings and specific language will be used to describe the same. It will nevertheless be understood that no limitation of the scope is thereby intended. Such alterations and further modifications in the illustrated device and such further applications are the principles disclosed as illustrated therein as being contemplated as would normally occur to one skilled in the art to which this disclosure relates.

In accordance with one principle aspect to the present disclosure, a packaging tray for transport and storage of product includes a tray portion and a plurality of cover portions. The tray portion is formed from a first sheet material and is defined by a plurality of removably connected retail portions. Each retail portion includes a plurality of pockets formed therein, each of which is adapted to receive the product. Each retail portion further includes an outer edge defined substantially about a periphery of the retail portion in at least one tab extending from the outer edge. Each at least one tab is removably connected with at least one tab of an adjacent retail portion along a line of weakening. The plurality of cover portions are formed from a second sheet material and are configured for removable engagement with one of the retail portions.

In another principal aspect of the present disclosure, a retail tray for storage and sale of product includes a retail portion and a cover portion. A retail portion includes a plurality of pockets formed therein, each adapted to receive the product. Each retail portion further includes an outer edge defined substantially about a periphery of the retail portion and a plurality of tabs that extend from the outer edge. There are at least two sets of tabs in the plurality of tabs. Each set of tabs is disposed on a discreet side defined on the outer edge. The cover portion is formed from a second sheet material and is configured for removable engagement with the retail portion.

FIG. 1 illustrates an exploded view of a packaging tray 22 for transport and storage of product 20. The packaging tray 22 includes a tray portion 24 in a plurality of cover portions 30. The tray portion 24 is defined by a plurality of removably connected retail portions 26. Each of the cover portions 30 independently and removably engages one of the retail portions 26. The product may be any item which is suitable for sale at retail. Embodiments of this disclosure are particularly advantageous when used in connection with fruit and vegetables. However, it is within the teachings of this disclosure that the product may include non-consumable items as well. For example, electronics, toys, flowers and any other products which may be subject to damage during shipment or any other suitable product may be used advantageously with the packaging tray.

Figure 2:
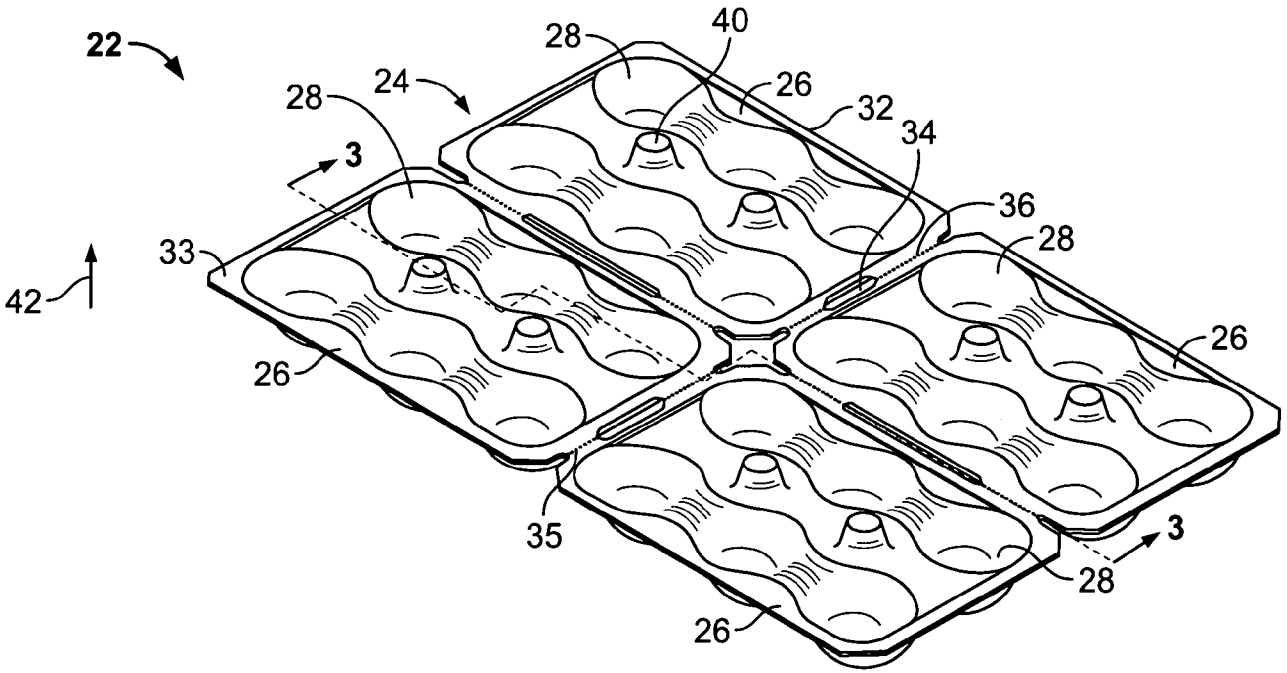
FIG. 2 illustrates a perspective view of a tray portion of the packaging tray of FIG. 1.
Figure 3A:
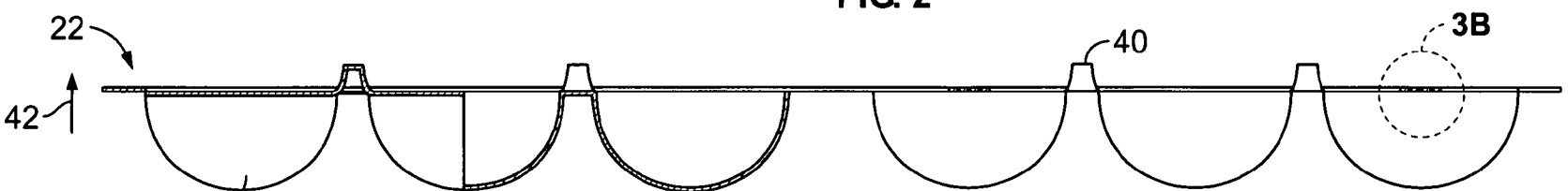
FIG. 3A illustrates a cross sectional view of the tray portion of FIG. 2.
Figure 3B:
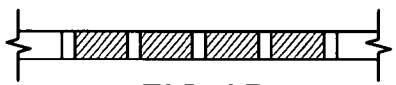
FIG. 3B illustrates a detailed view of a portion of the tray of FIG. 3A.

FIG. 2 illustrates a perspective view of a tray portion 24 of the packaging tray of FIG. 1. FIG. 3A illustrates a cross sectional view of the tray portion of FIG. 2 and FIG. 3B illustrates a detailed view of a portion of the tray of FIG. 3A. The tray portion 24 is formed from a first sheet material, which may, in one embodiment, be formed from a molded pulp fiber material, so as to take advantage of the unique features of molded pulp with regards to crushability to cushion and contain transmitted shock and the ability to be molded into complex stable shapes, as well as the strength of such material. It is within the teachings of the present disclosure that other materials, natural, synthetic or otherwise could be utilized as the first sheet material.

Each retail portion 26 includes a plurality of pockets 28 formed therein. The pockets 28, as shown, are configured as a generally contoured recesses that are adapted to individually receive one of the product 20. It is within the teachings of the present disclosure that the pockets 28 may take any shape, form or contour as may be desired to generally compliment the dimensions and shape of the product 20 to provide support, cushioning and otherwise protect the product 20. It will be recognized by those of skill in the art that any other suitable configuration of the pockets 28 may be made and disposed within each retail portion 26 to be utilized within the present disclosure.

Each retail portion 26 further includes an outer edge 32 defined substantially about a periphery 34 of a first planar margin 33 of the retail portion 26. At least one tab 36 extends from the outer edge 32 and is formed integrally with the first planar margin 33. Each tab 36 is removably connected to one tab 36 of an adjacently disposed retail portion 26 along a line of weakening 38. Generally, the line of weakening 38 may be configured in any known manner. For example, the line of weakening 38 may be formed by a series of perforations, scores, cuts or tears disposed in a line in the material between the removably connected tabs 36, such that adjacently disposed retail portions 26 may be disconnected from one another easily along the line of weakening 38. FIG. 3B illustrates one potential embodiment of the formation of the line of weakening. It is within the teachings of the present disclosure that other configurations for such line of weakening 38 could be utilized to perform the function discussed above.

In one embodiment each retail portion 26 further includes at least one alignment boss 40 formed therein that extends in a direction, identified by arrow 40, that is opposite of a direction of extension of the pockets 28. The function associated with each alignment loss 40 will be discussed in more detail below.

In this embodiment of the present disclosure, the plurality of tabs 36 associated with each retail portion 26 include at least two sets thereof. Each set of tabs 36 is disposed on a discrete side defined on the outer edge 32 and first substantially planar margin 33. It is within the teachings of the present invention that the number of sides defined on the outer edge 32 and first planar margin 33 is not limited to four as shown. Other configurations of discrete sides defined on the outer edge 32 and first planar margin 33 could be utilized with the present disclosure. For example, it may be advantageous to form a retail portion 26 having three, five, six, seven, eight or more discrete sides defined on the outer edge 32 and first planar margin 33. Those of skill in the art will recognize that the dimensions and shape of the product may dictate the configuration, number and the layout of the pockets 28 on any given retail portion 26.

In one embodiment, the corner 44 between adjacent discrete sides defined on the outer edge 32 and first planar margin 33 is disposed oblique with respect to such adjacent sides. It is within the teachings of the present invention that other corner configurations could be utilized within the present disclosure.

Figure 4:
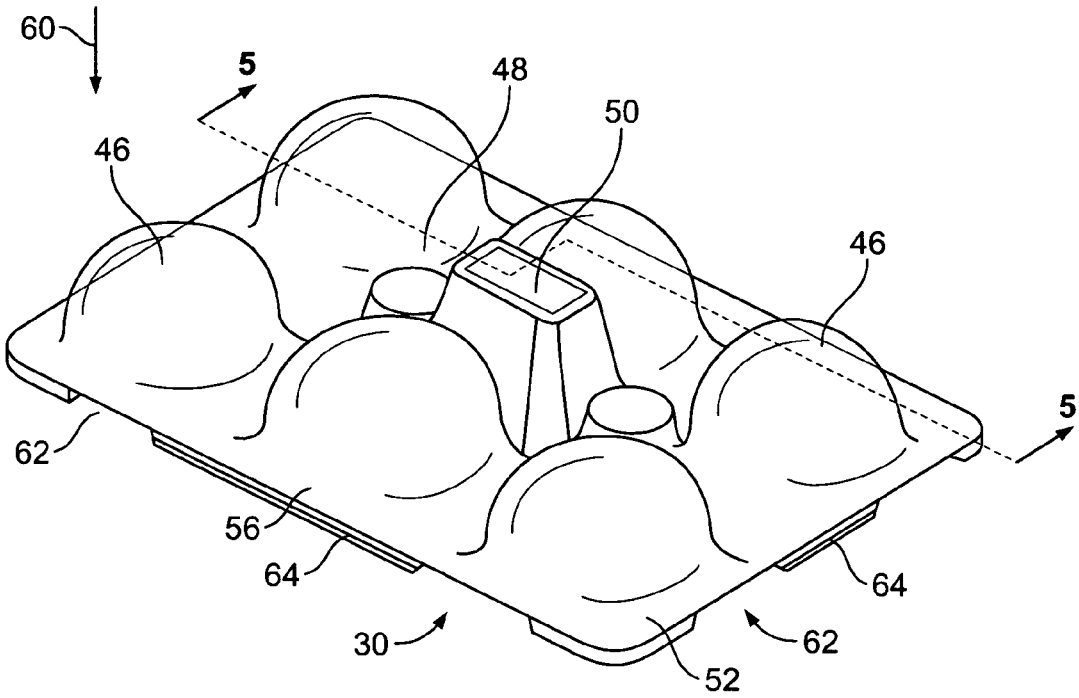
FIG. 4 illustrates a perspective view of a cover portion of the packaging tray of FIG. 1.
Figure 5:
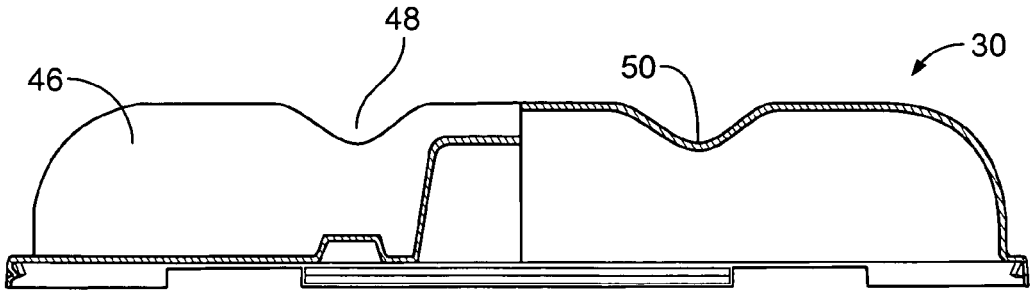
FIG. 5 illustrates a cross sectional view of the cover portion of FIG. 4.

FIG. 4 illustrates a perspective view of a cover portion of the packaging tray of FIG. 1. FIG. 5 illustrates a cross sectional view of the cover portion of FIG. 4. The cover portion 30 is formed from a second sheet material. Preferably, the second sheet material is formed from any transparent material. For example, the second sheet material may be plastic or any other synthetic or natural substance capable of being formed to perform the functions described herein. Alternatively, the second sheet material may be formed from a translucent material. It will be recognized by those of ordinary skill in the art that it is particularly advantageous that the product 20 be visible or at least somewhat visible through the second sheet material.

Each cover portion 30 is configured for removable engagement with one of the retail portions 26. Accordingly, separation of the retail portions 26 from one another does not require any additional force to separate adjacent cover portions 30 from one another.

Figure 6:
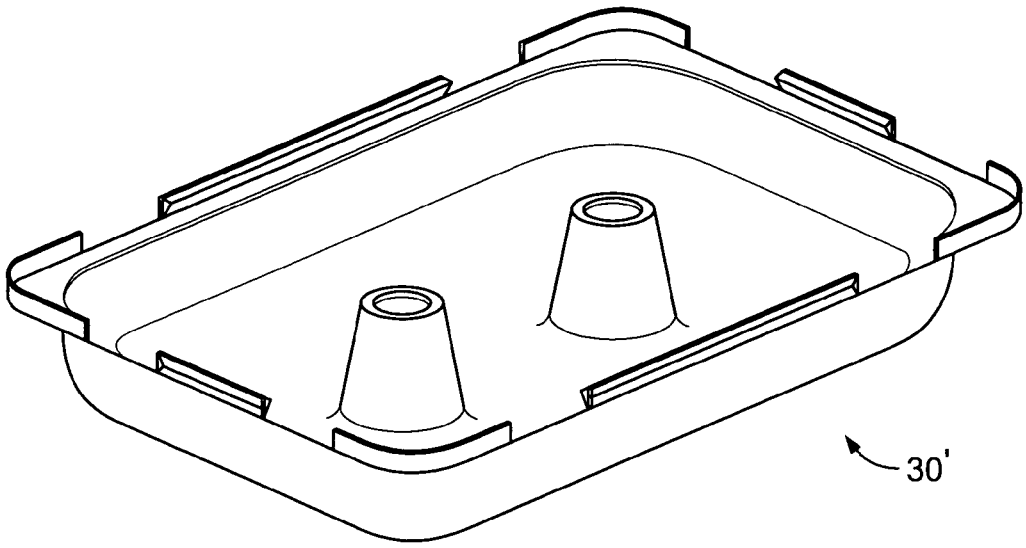
FIG. 6 illustrates a perspective view of an alternative embodiment of a cover portion of the packaging tray.

In one embodiment, the cover portions 30 each have a plurality of recesses 46 formed therein. Each recess 46 is configured and disposed in the cover portion 30 for substantial alignment with one of the pockets of the retail portion. It is within the teachings of the present invention that other configurations of the cover portion 30 may be utilized for the functions described herein. For example, FIG. 6 illustrates a perspective view of an alternative embodiment of a cover portion 30' of the packaging tray. As shown in this embodiment, the cover portion 30' does not have the plurality of recesses formed therein. However, other structural and functional features described with respect to the cover portion 30 may be likewise formed therein.

Referring back to FIGS. 4 and 5 it is within the teachings of the present invention that the recesses 46 may have any suitable configuration for use in connection with supporting, cushioning and otherwise protecting the product.

The cover portions 30 preferably each have at least one alignment column 48 formed therein such that when the cover portion 30 engages a retail portion, each alignment column 48 is disposed to engage one alignment boss. It will be recognized by those of skill in the art that such aligned columns and bosses provide additional support to the cover portion 30 when packaging trays or retail portions are stacked on top of each other. A label pad 50 may also be utilized to provide a surface on which a manufacturer or retailer may provide information about the product that is useful to end users.

The cover portions 30 each further include a second substantially planar margin 52 defined about a periphery 54 of the cover portion and thereby defined an exterior edge 56 thereabout. A segmented lip element 58 extends from the exterior edge 56 in a direction, identified by arrow 60, opposite of the direction of extension of the recesses 46. At least one opening 62 is defined in the segmented lip element 58. Each opening 62 is configured and oriented to receive each tab so as to permit the tab to extend beyond the exterior edge 56 and. The lip element 58, extending in the direction 60, substantially overlies the outer edge of the retail portion, such that the second planar margin 52 is in a substantially continuous face-to-face contact with the first planar margin defined on the retail portion.

Figure 10:
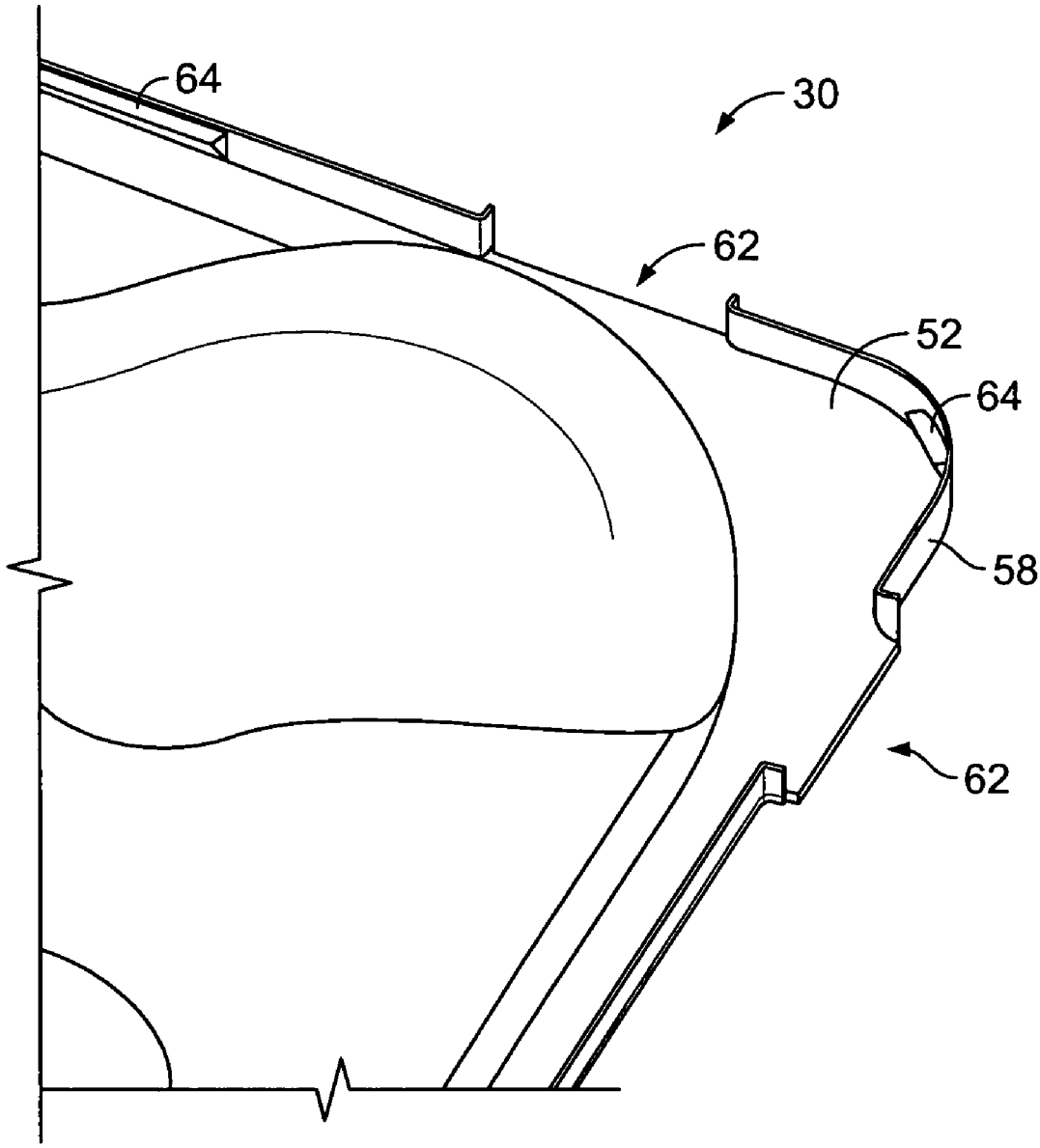
FIG. 10 illustrates a detail view of lock projections of the cover portion.

In one embodiment, the lip element 58 further includes at least one lock projection 64 which captures the outer edge of the retail portion to removably connect the cover 30 to the retail portion and define a retail tray 70. The lock portion 64 is generally configured as an indentation or bump formed in the lip element 58 extending toward an opposite side of the cover portion 30, as also shown in FIG. 10. It is within the teachings of the present invention that other configurations for the lock projection 64 could be utilized for the same function. For example, as shown in FIG. 10, the lock projection 64 may be disposed in a corner location advantageous to engage an oblique corner discussed above. Other configurations of lock projections 64 could be utilized with the present disclosure to perform the intended function.

Figure 7:
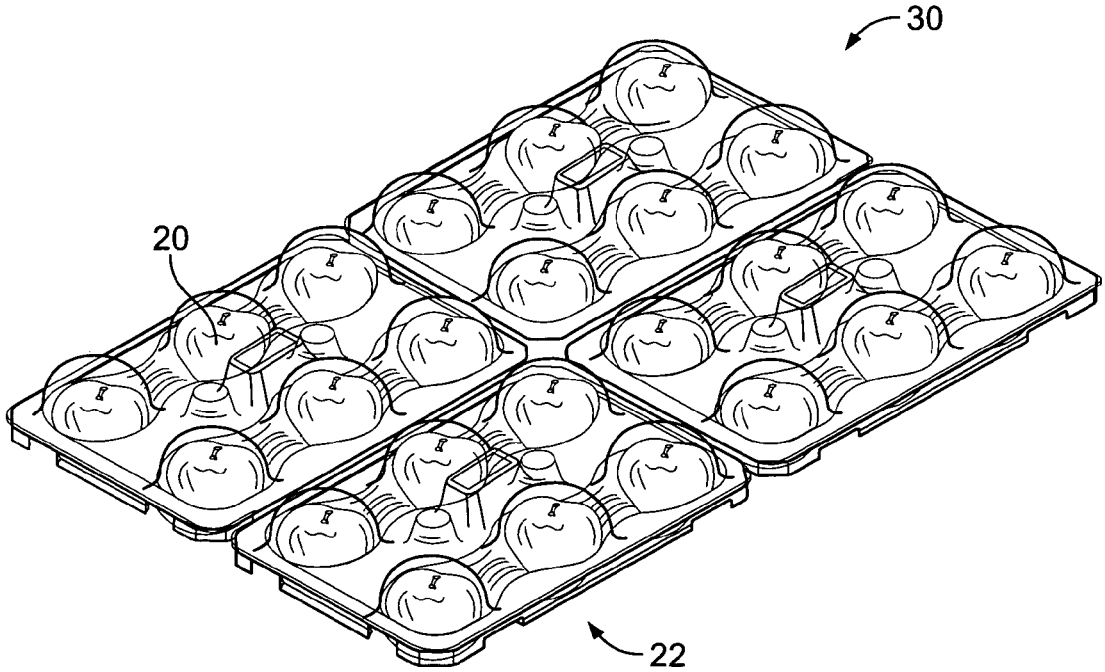
FIG. 7 illustrates a perspective view of the packaging tray of FIG. 1.

FIG. 7 illustrates a perspective view of the packaging tray 22 of FIG. 1. A cover portion 30 is disposed to removably engage each retail portion 26. It will be recognized by those of skill in the art that the product 20 is captured between the pockets and recesses which closely compliment the general shape and dimension of the product 20. The label pads 50 also provide sufficient area for the retailer or manufacturer to provide a label for use by a consumer and identification of a product.

Figure 8:
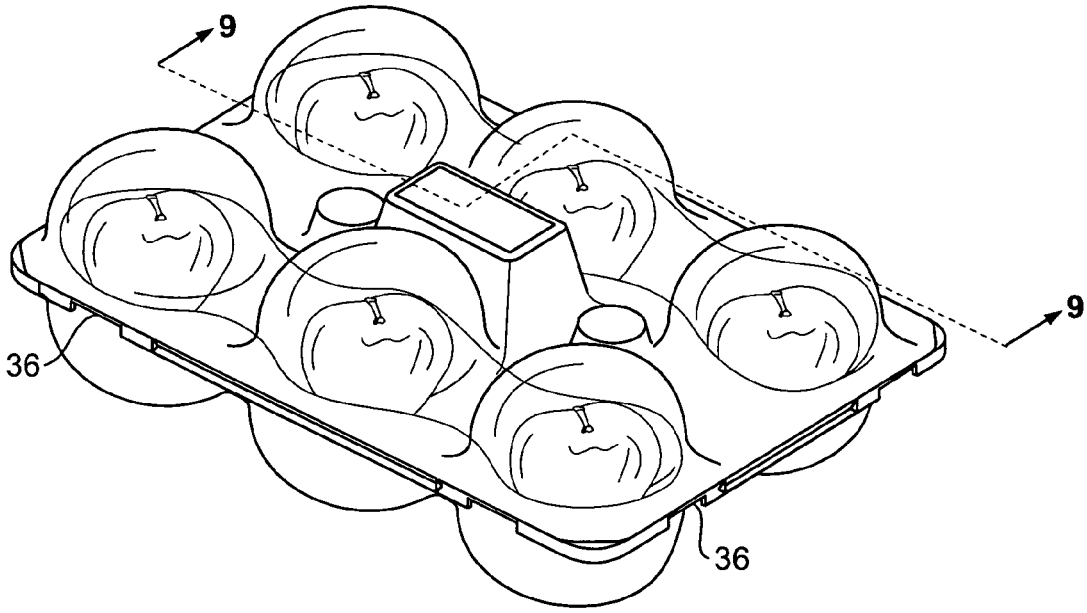
FIG. 8 illustrates a perspective view of a retail tray.

FIG. 8 illustrates a perspective view of a retail tray 70. The cover portion 30 removably engages the retail portion 26. Again, the product 20 is safely contained in the envelope defined by the substantially vertically aligned pockets and recesses. As described in detail above, the retail portion 26 is defined after separation of the tabs of one retail portion 26 from another one or two, in this embodiment, retail portions 26 of the tray portion.

Figure 9:
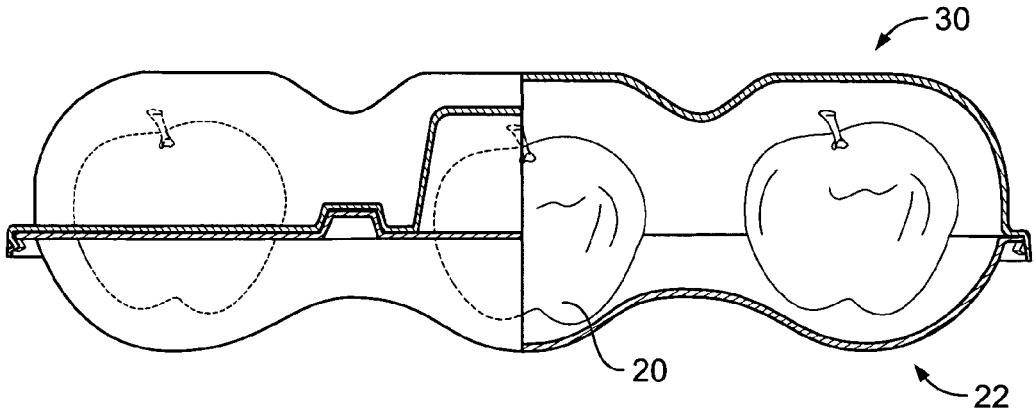
FIG. 9 illustrates a cross sectional view of the retail tray of FIG. 8.

FIG. 9 illustrates a cross sectional view of the retail tray of FIG. 8. In this embodiment, the alignment column 48 is substantially vertically aligned with the alignment boss 40 such that engagement therebetween provides additional reinforcement and support to the cover portion 30 such that externally applied forces and impacts are distributed to the retail portion 26 and amongst the various alignment columns and bosses and the first and second planar margins of the retail and cover portions. It will be further noted that the lock projections 64 extend inwardly so as to define a small receptacle between the top of the lock projection 64 and the bottom of the second planar margin of the cover portion to capture the outer edge of the retail portion 26. Further, as shown, the second planar margin 52 is disposed in contiguous surface-to-surface contact with the first planar margin 33 of the retail portion 26.

Furthermore, while the particular preferred embodiments have been shown and described, it will be obvious to those skilled in the art that changes and modifications may be made without departing from the teaching of the disclosure. The matter set forth in the foregoing description and accompanying drawings is offered by way of illustration only and not as limitation. The actual scope of the disclosure is intended to be defined in the following claims when viewed in their proper perspective based on the related art.

What is claimed is:

1. A packaging tray for transport and storage of product comprising:

a tray portion formed from a first sheet material and defined by a plurality of removably connected retail portions;

each retail portion including a plurality of pockets formed therein, the pockets each adapted to receive the product and having a first planar margin in the respective periphery of each retail portion;

each retail portion further including an outer edge defined substantially about a periphery of the retail portion and at least two tabs extending from the outer edge on at least two discrete sides along the first planar margin; and each of the at least two tabs removably connected with one at least one tab of an adjacent retail portion along a line of weakening extending from the outer edge on the at least two discrete sides along the first planar margin; and a plurality of cover portions formed from a second sheet material and each cover portion having a lip element, the cover portion configured for removable engagement with one of the retail portions; whereby the retail portions are separable from one another, and wherein at least a section of the lip element is substantially overlying the outer edge between the at least two tabs.

2. The tray as recited in claim 1, wherein each retail portion further includes at least one alignment boss formed therein that extends in a direction opposite the pockets.

3. The tray as recited in claim 2, wherein the cover portions each have said at least one alignment column formed therein, each alignment column disposed to engage one at least one alignment boss.

4. The tray as recited in claim 1, wherein the cover portions each have a plurality of recesses formed therein, each recess configured for substantial alignment with one of the pockets of the retail portions.

5. The tray as recited in claim 1, wherein the cover portions each further include a substantially planar margin defined about a periphery of the cover portion defining an exterior edge thereabout.

6. The tray as recited in claim 5, wherein the segmented lip element extends from the exterior edge in a direction opposite the recesses to define said at least one opening, each at least one opening oriented to engage one at least one tab.

7. The tray as recited in claim 1, wherein the lip element extending in a direction opposite the recesses and substantially overlying the outer edge.

8. The tray as recited in claim 7, wherein the lip element further includes at least one lock projection which captures the outer edge to removably connect the cover portion to the retail portion and define a retail tray.

9. The tray as recited in claim 1, wherein the line of weakening is formed by a series of perforations.

10. A retail tray for storage and sale of product comprising:

a retail portion formed of a first sheet material including a plurality of pockets formed therein, the pockets each adapted to receive the product;

the retail portion further including an outer edge defined substantially about a periphery of the retail portion, a first planar margin and a plurality of tabs that extend from the outer edge along the first planar margin;

the plurality of tabs including at least two sets thereof;

each set of tabs disposed on a discrete side defined on the outer edge; and a cover portion formed from a second sheet material and configured for removable engagement with the retail portion.

11. The tray as recited in claim 10, wherein the cover portion has a plurality of recesses formed therein, each recess oriented for substantial alignment with one of the pockets of the retail portion.

12. The tray as recited in claim 11, wherein the cover portion further includes at least one alignment column formed therein, each alignment column disposed to engage one at least one alignment boss.

13. The tray as recited in claim 12, wherein a segmented lip element extends from the exterior edge in a direction opposite the recesses to define a plurality of openings, each opening oriented to engage one of the tabs.

14. The tray as recited in claim 10, wherein the retail portion further includes at least one alignment boss formed therein that extends in a direction opposite the pockets.

15. The tray as recited in claim 10, wherein the cover portion further includes a substantially planar margin defined about a periphery of the cover defining an exterior edge thereabout.

16. The tray as recited in claim 11, wherein the cover portion further includes a lip element extending in a direction opposite the recesses and substantially overlying the outer edge.

17. The tray as recited in claim 16, wherein the lip element further includes at least one lock projection which captures the outer edge to removably connect the cover portion to the retail portion.

* * * * *